US010422062B2

(12) United States Patent
Debuf

(10) Patent No.: US 10,422,062 B2
(45) Date of Patent: Sep. 24, 2019

(54) TUFTING MACHINE

(71) Applicant: NV Michel van de Wiele, Kortrijk/Marke (BE)

(72) Inventor: Geert Debuf, Drongen (BE)

(73) Assignee: VANDEWIELE NV, Kortrijk/Marke (BE)

( * ) Notice: Subject to any disclaimer, the term of this patent is extended or adjusted under 35 U.S.C. 154(b) by 29 days.

(21) Appl. No.: 15/562,207

(22) PCT Filed: Oct. 30, 2015

(86) PCT No.: PCT/EP2015/075262
§ 371 (c)(1),
(2) Date: Sep. 27, 2017

(87) PCT Pub. No.: WO2016/165790
PCT Pub. Date: Oct. 20, 2016

(65) Prior Publication Data

US 2018/0119322 A1 May 3, 2018

(30) Foreign Application Priority Data

Apr. 16, 2015 (EP) ..... 15163793

(51) Int. Cl.
*D05B 71/00* (2006.01)
*D05C 15/08* (2006.01)

(52) U.S. Cl.
CPC ..... *D05B 71/00* (2013.01); *D05C 15/08* (2013.01)

(58) Field of Classification Search
CPC ..... D05B 71/00; D05B 71/02; D05B 71/04; D05C 15/08
See application file for complete search history.

(56) References Cited

U.S. PATENT DOCUMENTS 3,382,681 A * 5/1968 Hagy ..... D05B 71/04 112/281
4,285,293 A * 8/1981 Martling ..... D05B 71/04 112/261
4,480,565 A * 11/1984 Harbst ..... D05B 71/04 112/281

(Continued)

FOREIGN PATENT DOCUMENTS

WO 2010003050 1/2010
WO 2010003050 A2 7/2010

OTHER PUBLICATIONS

International Search Report and Written Opinion of PCT/EP2015/075261 dated Dec. 4, 2015, 12 pages.

(Continued)

*Primary Examiner* — Danny Worrell
(74) *Attorney, Agent, or Firm* — Rankin, Hill & Clark LLP

(57) ABSTRACT

A tufting machine comprises a needle bar and a needle bar drive mechanism for moving the needle bar towards and away from a backing material passed through a tufting zone by means of a backing material feed mechanism. The machine further comprises at least one controller and a cooling liquid system for cooling at least one controller, the cooling liquid system comprising at least one cooling member having a cooling liquid channel for the passage of a cooling liquid and being in heat transfer contact with at least a part of the electrical components of a controller.

19 Claims, 6 Drawing Sheets

(56) References Cited

U.S. PATENT DOCUMENTS

| | | | | |
|---|---|---|---|---|
| 5,653,184 | A * | 8/1997 | Bardsley | D05B 71/00 112/280 |
| 7,215,547 | B2 * | 5/2007 | Chang | H05K 1/0272 165/104.33 |
| 2007/0297145 | A1 * | 12/2007 | Karrer | H01L 23/3735 361/720 |
| 2008/0212281 | A1 * | 9/2008 | Kerner | B60R 16/0239 361/701 |
| 2009/0260554 | A1 * | 10/2009 | Hall | D05C 15/34 112/80.4 |
| 2018/0119322 | A1 * | 5/2018 | Debuf | D05C 15/08 |

OTHER PUBLICATIONS

Siemens: "SINAMICS S120—Chassis Power Units, Liquid-Cooled", Apr. 10, 2014, https://cacheindustry.siemens.com/dl/files/333/92544333/att 84024/vl/SINAMICS_S120 Chassis Power Units LC en-US.pdf.

Siemens: "SINAMICS S120—Chassis Power Units, Liquid-cooled", Apr. 10, 2014, chapters 2 and 9, XP002743566, Retrieved from the Internet: URL:https://cacheindustry.siemens.com/dl/files/333/92544333/att_84024/v1/SINAMICS_S120_Chassis_Power_Units_LC_en-US.pdf [retrieved on Aug. 21, 2015], 416 pages.

International Search Report and Written Opinion of PCT/EP2015/075262 dated Oct. 17, 2017, 8 pages.

* cited by examiner

TUFTING MACHINE

The present invention relates to a tufting machine for producing tufted fabrics, for example carpets.

Such a tufting machine is known from WO 2010/003050 A2. This tufting machine comprises a needle bar and a needle bar drive mechanism for moving the needle bar towards and away from a backing material that is passed through a tufting zone by means of a backing feed mechanism. For shifting the needle bar in a direction perpendicular with respect to the backing material feeding direction a needle bar shifting mechanism is provided. For feeding yarns to the needles of the needle bar yarn feed assemblies are provided. Further a hook assembly is provided below the tufting zone. As the needles penetrate the backing material the yarns moved by the needles are engaged by the hook assembly so as to form loops of yarn. The various movable components of the tufting machine or moved by motors associated to these components. For example the needle bar is moved by a motor of the needle bar drive mechanism. The backing material is passed through the tufting zone by means of one or a plurality of motors driving respective backing feed rolls. Further the yarn feed assemblies as well as the hook assembly have motors associated thereto. All the motors are under the control of a common controller. The controller monitors and controls the operation of the operative elements, e.g. the various motors, of the tufting machine.

It is an object of the present invention to provide a tufting machine in which the thermal load of components thereof can be reduced.

According to the present invention, this object is achieved by a tufting machine, comprising a needle bar and a needle bar drive mechanism for moving the needle bar towards and away from a backing material passed through a tufting zone by means of a backing material feed mechanism, further comprising at least one controller and a cooling liquid system for cooling at least one controller, the cooling liquid system comprising at least one cooling member having a cooling liquid channel for the passage of a cooling liquid and being in heat transfer contact with at least a part of the electrical components of a controller.

In the machine according to the present invention, electrical components of at least one controller are cooled by providing a direct heat transfer contact between these components and the cooling liquid system. Therefore, the use of an air flow for taking up heat from the electrical components to be cooled and transferring this heat to the cooling liquid, for example, in a secondary heat exchanger, can be avoided. Due to this, the cooling liquid system used in the machine of the present invention provides a substantially increased cooling efficiency.

For providing an efficient heat transfer between electrical components to be cooled and the cooling liquid system, at least one cooling member may comprise at least one cooling plate, at least a part of the electrical components being supported by at least one cooling plate, and/or at least one cooling member may comprise a body of an electrical component, such that a cooling liquid can be passed directly through such an electrical component.

The cooling liquid system may comprise a primary cooling liquid circuit and a primary cooling liquid flowing through the primary cooling liquid circuit, and may further comprise a primary heat exchanger for cooling the primary cooling liquid. By the use of such a primary heat exchanger, the primary cooling liquid can be cooled for providing this primary cooling liquid in a condition in which heat can be withdrawn from electrical components to be cooled.

For further enhancing the efficiency of the machine according to the present invention, the cooling liquid system may comprise at least one secondary cooling liquid circuit and a secondary cooling liquid flowing through the secondary cooling liquid circuit and passing through the cooling liquid channel of at least one cooling member. By using one or a plurality of such secondary cooling liquid circuits, the heat transfer capacity can be easily adapted to the cooling requirements of the various controllers to be cooled.

For transferring heat between the primary cooling liquid circuit and one or a plurality of secondary cooling liquid circuits, the cooling liquid system may comprise at least one secondary heat exchanger for transferring heat from the secondary cooling liquid of at least one secondary cooling circuit to the primary cooling liquid of the primary cooling circuit, and/or the cooling liquid system may comprise at least one valve means for bringing at least one secondary cooling liquid circuit into and out of cooling liquid exchange communication with the first cooling liquid circuit.

For providing the thermal interaction between the primary cooling liquid circuit and at least one secondary cooling liquid circuit on the one hand and for additionally providing the option of generating a cooling liquid exchange communication between the primary cooling liquid circuit and at least one secondary cooling liquid circuit, the cooling liquid system may comprise at least one multifunctional regulator comprising a valve means and a secondary heat exchanger for cooling a secondary cooling liquid by means of the primary cooling liquid in a condition in which the primary cooling liquid circuit is brought out of cooling liquid exchange communication with at least one secondary cooling liquid circuit by the valve means.

According to an advantageous aspect of the present invention, at least one secondary heat exchanger may be arranged for transferring heat from the secondary cooling liquids of at least two secondary cooling liquid circuits to the primary cooling liquid of the primary cooling liquid circuit, and/or at least one valve means may be arranged for bringing at least one secondary cooling liquid circuit of a plurality of secondary cooling liquid circuits into and out of cooling liquid exchange communication with the primary cooling liquid circuit. In such a system, a plurality of controllers can be cooled independently of each other by using different secondary cooling liquid circuits in association with each one of these controllers.

For further enhancing the cooling capacity of the machine according to the present invention, at least one cooling member may comprise a first cooling member portion in heat transfer contact with electrical components of a controller and a second cooling member portion not in heat transfer contact with electrical components of a controller for providing a heat exchanger area for cooling ambient air. In such an embodiment, it is further advantageous to provide a fan associated with at least one controller for generating an ambient air flow through the controller. This air flow can be passed around the second cooling member portion for cooling this air flow and for using this cooled air flow as an additional means for cooling components of a controller.

For avoiding overheating of electrical components as well as for avoiding a situation in which the temperature of electrical components drops below a desired level, means for adjusting the amount of cooling liquid passing through the cooling liquid channel of at least one cooling member may be provided, and/or means for adjusting the temperature of the cooling liquid passing through the cooling liquid channel of at least one cooling member may be provided. For example, the machine may be arranged such that the means for adjusting the amount of cooling liquid passing through the cooling channel of at least one cooling member comprise a cooling liquid pump and/or a valve, and/or the means for adjusting the temperature of the cooling liquid passing through the cooling liquid channel of at least one cooling member comprise means for adjusting the amount of primary cooling liquid flowing through at least one first secondary heat exchanger.

For protecting the electrical components of the controller and for further increasing the cooling efficiency of the cooling liquid system according to the present invention, at least one controller may comprise a controller cabinet, at least part of the electrical components of the controller and at least one cooling member being arranged inside the controller cabinet.

The tufting machine of the present invention may be arranged such that one controller is provided for controlling the operation of all motors of the tufting machine. In an alternative embodiment a plurality of controllers may be provided for controlling the operation of all motors of the tufting machine. In either case the cooling liquid system may be arranged such as to cool components of one or a plurality of tufting machines.

For enhancing the cooling capacity of the cooling system in at least one cooling liquid circuit of the cooling liquid system at least two cooling members may be arranged serially and/or at least two cooling members are arranged in parallel with each other for the passage of cooling liquid flowing in the cooling liquid circuit, wherein at least two of the cooling members may be associated with different controllers.

Further, at least one motor controlled by a controller may be cooled by a cooling liquid flowing in a cooling liquid circuit of the cooling liquid system. Preferably, in at least one cooling liquid circuit, at least one cooling member and at least one motor may be arranged serially or in parallel to each other for the passage of cooling liquid flowing in the cooling liquid circuit.

For providing an increased heat transfer capacity according to an advantageous aspect of the present invention at least one cooling member may be in heat transfer contact with electrical components at two opposing sides thereof.

For allowing a simple and quick installation and/or exchange of electrical components at at least one side of at least one cooling member at least one electrical component may be removably supported. It is to be noted that in the context of the present invention the expression "removably supported" means that such an electrical component can be attached to and detached from the supporting cooling plate without destroying the cooling plate and the electrical component. For providing such a removable connection of an electrical component with a cooling member connecting means like screws, rivets, snap fit connectors or press fit connectors may be used.

According to a further aspect, the present invention provides a method of operating a cooling system, for example, of a machine according to the present invention, wherein a cooling liquid temperature is controlled such as to have a predetermined preferably substantially constant deviation from an ambient air temperature. By controlling the cooling liquid temperature in such a manner, water condensation can be avoided, which is of great importance if such a cooling system is used for cooling electrical components, for example, of a controller.

The present invention will now be explained with respect to the drawings in which.

Figure 1:
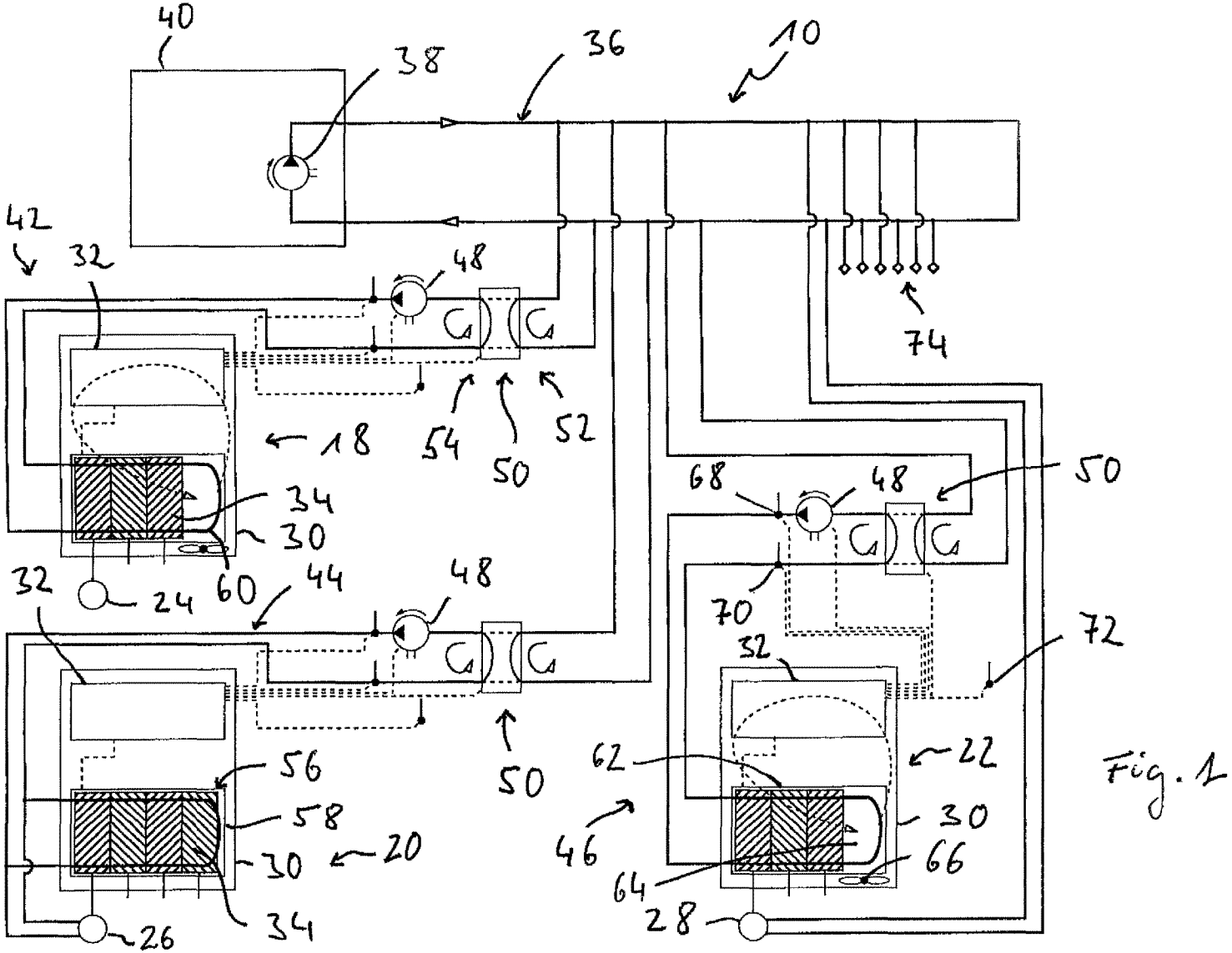
FIG. 1 shows the principal construction of a cooling system in a tufting machine for producing tufted fabrics.

In FIG. 1, a cooling liquid system 10 for a tufting machine is shown. The principal construction of such a tufting machine has been described above with reference to the prior art. It is to be noted that, insofar as the overall construction of the tufting machine of the present invention is concerned, the machine may be arranged in a manner known in the prior art, for example as known from WO 2010/003050 A2. This means that the tufting machine according to the present invention comprises various operative assemblies, e.g. the needle bar drive mechanism, the needle bar shifting mechanism, the backing feed mechanism, the hook assembly, the yarn feed assembly as well as all the further assemblies which have to be controlled for carrying out the tufting procedure. As at least a part of these assemblies, preferably all these assemblies, comprise motors which for moving associated components have to be controlled by an associated controller. According to the principles of the present invention one single controller may be provided for controlling all the operative assemblies of one tufting machine. However, in association to one tufting machine there may be plurality of controllers for controlling different operative assemblies of this tufting machine. For example, there may be one controller for controlling the operation of the needle bar drive mechanism, while there is another controller for controlling the operation of the needle bar shifting mechanism.

In the following description referring to the various embodiments shown in the figures, a plurality of controllers and their thermal interaction with the cooling liquid system 10 will be described. In FIG. 1, for example three such controllers 18, 20, 22 are shown. These controllers may be controllers of one single tufting machine provided for controlling the operation of different assemblies of this tufting machine. However, the controllers shown in the figures and described with respect to the figures may be controllers of different tufting machines for example located within the same building, each one of these tufting machines for example comprising only one controller for controlling the operation of all the assemblies, i.e. all the motors, thereof.

It is to be noted that, while the following description will be given with respect to the controllers 18, 20, 22 shown in FIG. 1, there may be other controllers which, insofar as their principal construction and their interaction with the cooling liquid system 10 is concerned, may have the same structure as the controllers 18, 20, 22 shown in FIG. 1. However, of course, there may be other or additional controllers having another construction and another way of interaction with the cooling liquid system 10. There may even be controllers which do not have a thermal interaction with the cooling liquid 10, but which, for example, may be cooled by other means.

Each one of the controllers 18, 20, 22 comprises a controller cabinet 30 containing electrical components of the controllers 18, 20, 22. For example, each controller 18, 20, 22 may comprise a controller unit 32 having one or a plurality of microcontrollers and/or other electrical components. These controller units 32 are used for generating control signals, for example, for controlling the operation of the respective motors 24, 26, 28 based on programs stored in the respective controller units 32 and/or based on information input into such a controller unit 32. Further, the controllers 18, 20, 22 comprise electrical components which are provided for outputting the power for energizing the respective motors 24, 26, 28. These electrical components, for example, may comprise inverters for applying a high voltage to the respective motors 24, 26, 28. These electrical components which generally may be considered as providing drives 34 for the motors 24, 26, 28 and which may comprise printed circuit boards are the components which, due to their high load in operation, produce quite high amounts of heat. These drives 34, together with other electrical components of the respective controllers 18, 20, 22, e.g. the control units 32, are contained within the respective controller cabinets 30. It is the primary focus of the cooling liquid system 10 of the present invention to take up heat generated by these drives 34 such as to avoid overheating of the electrical components contained within the respective controller cabinets 30. However, it is to be noted that, by means of the cooling liquid system 10 of the present invention, other or additional electrical components of one or of a plurality of the controllers 18, 20, 22 can be cooled.

The cooling liquid system 10 of the present invention comprises a primary cooling liquid circuit 36 in which, by means of a pump 38, a primary cooling liquid, for example, water, is circulated. For cooling this primary cooling liquid, the primary cooling liquid circuit 30 comprises a primary heat exchanger 40. For example, this primary heat exchanger 40 may be part of an air-cooled refrigeration condensing unit in which a cooling liquid is circulated between a condenser and an evaporator. In the primary heat exchanger 40, the heat transported in the primary cooling liquid, for example, may be transferred to the ambient air outside a building in which one or a plurality of tufting machines are positioned.

In association with each one of the controllers 18, 20, 22, there is provided a respective secondary cooling liquid circuit 42, 44, 46. Each of these secondary cooling liquid circuits 42, 44, 46 comprises a respective pump 48 by means of which a secondary cooling liquid is circulated within the secondary cooling liquid circuits 42, 44, 46. For example, the secondary cooling liquid used in the secondary cooling liquid circuits 42, 44, 46 may be water.

In association with each one of the secondary cooling liquid circuits 42, 44, 46, there is provided a multifunctional regulator 50 which, in a condition shown in FIG. 1, is operated as a secondary heat exchanger 52 for transferring heat from the secondary cooling liquid flowing in the secondary cooling liquid circuits 42, 44, 46 to the primary cooling liquid flowing in the primary cooling liquid circuit 36. In this operational condition, the multifunctional regulator 50 separates the primary cooling liquid circuit 36 from the various secondary cooling liquid circuits 42, 44, 46, but provides a heat transfer contact between the secondary cooling liquids flowing in the secondary cooling liquid circuits 42, 44, 46 and the primary cooling liquid flowing in the primary cooling liquid circuit 36.

The multifunctional regulators 50 may further comprise valve means 54 by means of which the primary cooling liquid circuit 36 can be separated from the secondary cooling liquid circuits 42, 44, 46 for providing the condition shown in FIG. 1. In another switching mode of the valve means 54, the primary cooling liquid circuit 36 is brought into cooling liquid exchange communication with the respective secondary cooling liquid circuits 42, 44, 46, as shown by dashed lines within the respective multifunctional regulators 50 of FIG. 1. In this condition, the primary cooling liquid flowing in the primary cooling liquid circuit 36 may enter the respective secondary cooling liquid circuits 42, 44, 46 for passing through the respective controllers 18, 20, 22 and then flowing back to the primary cooling liquid circuit 36 via the associated multifunctional regulators 50. In this condition, the primary cooling liquid circuit 36 and the secondary cooling liquid circuits 42, 44, 46, which are in cooling liquid exchange communication with the primary cooling liquid circuit 36, act as one cooling liquid circuit having one and the same cooling liquid passing there through. Due to this, it is advantageous to use the same kind of cooling liquid for the primary cooling liquid circuit 36 and the secondary cooling liquid circuits 42, 44, 46 as, in the condition in which there is a cooling liquid exchange communication, these cooling liquids will become intermixed. As indicated in FIG. 1, each one of the multifunctional regulators 50 is under control of the control unit 32 of the one controller 18, 20, 22 which is to be cooled by the respective secondary cooling liquid circuit 42, 44, 46, such that the multifunctional regulators 50 can be switched between the two above-referenced conditions independently of each other. For example, during cooling operation, the secondary cooling liquid circuit 42 may be separated from the primary cooling liquid circuit 36, while the other secondary cooling liquid circuits 44, 46 are in cooling liquid exchange communication with the primary cooling liquid circuit 36. The respective switching condition of the multifunctional regulators 50 can be selected on the basis of various parameters, for example, on the basis of the amount of heat which has to be withdrawn from the respective controllers 18, 20, 22.

For withdrawing heat in particular from the heat generating drives 34 of the various controllers 18, 20, 22, the cooling liquid system 10 comprises at least one cooling member 56 in association with each one of the controllers 18, 20, 22. In the embodiment shown in FIG. 1, one such cooling member 56 is provided within the controller cabinet 30 of each one of the controllers 18, 20, 22. In an advantageous embodiment, each cooling member 56 may comprise at least one cooling plate 58, for example, made of metal material and providing a cooling liquid channel 60 for the passage of the cooling liquid, for example, the secondary cooling liquid, flowing in the associated secondary cooling liquid circuit 42, 44, 46. The drives 34 which are to be cooled by means of the cooling liquid circuit 10 are directly mounted on at least one side of the cooling plates 58 such that there is a direct thermal contact between these drives 34 and their electrical components, respectively, and the cooling plates 58. Due to this direct heat transfer contact, the heat generated by the electrical components of the drives 34 can be withdrawn from the drives 34 and taken up in the secondary cooling liquid flowing through a respective cooling liquid channel 60 in a very efficient manner. In a further embodiment, the electrical components to be cooled, i.e. electrical components of the drives 34, may be arranged such as to have bodies providing cooling liquid channels such that the cooling liquid can be passed directly through these electrical components to be cooled.

Figure 6:
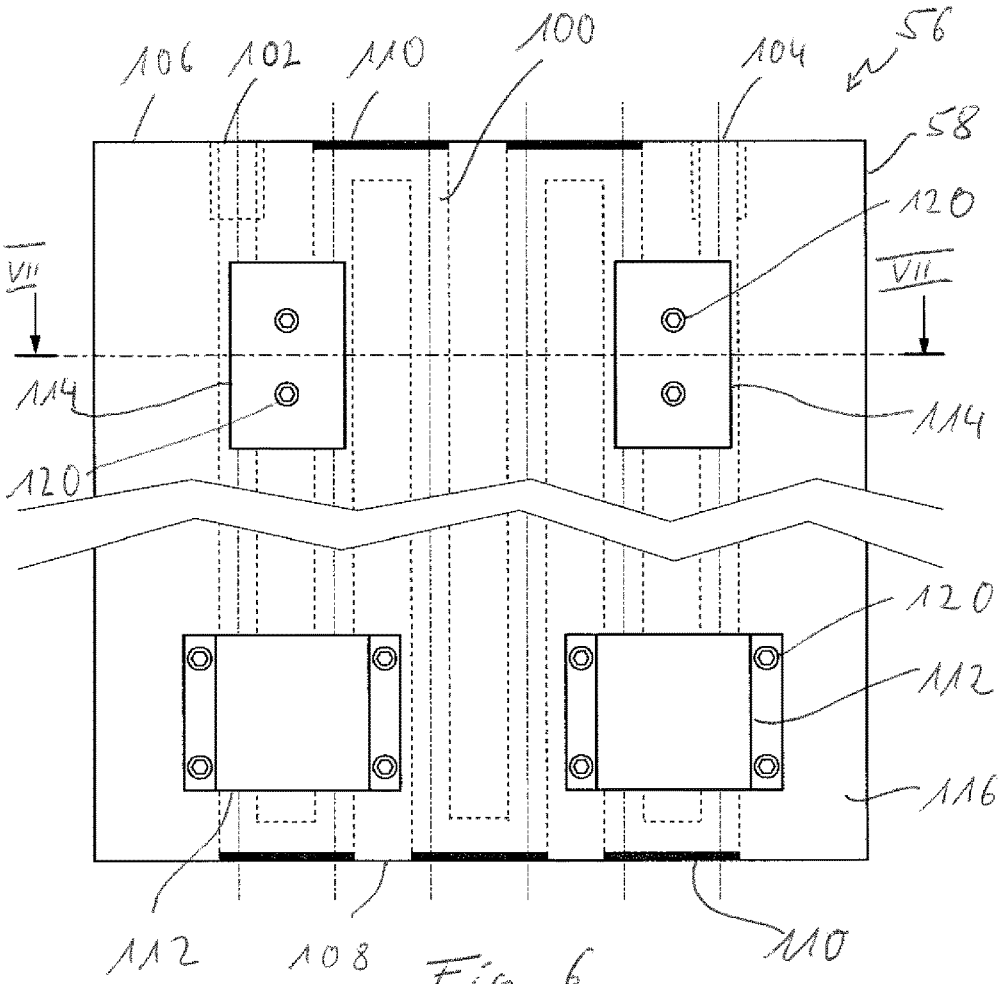
FIG. 6 shows a top view of a cooling plate having a plurality of electrical components supported thereon.
Figure 7:
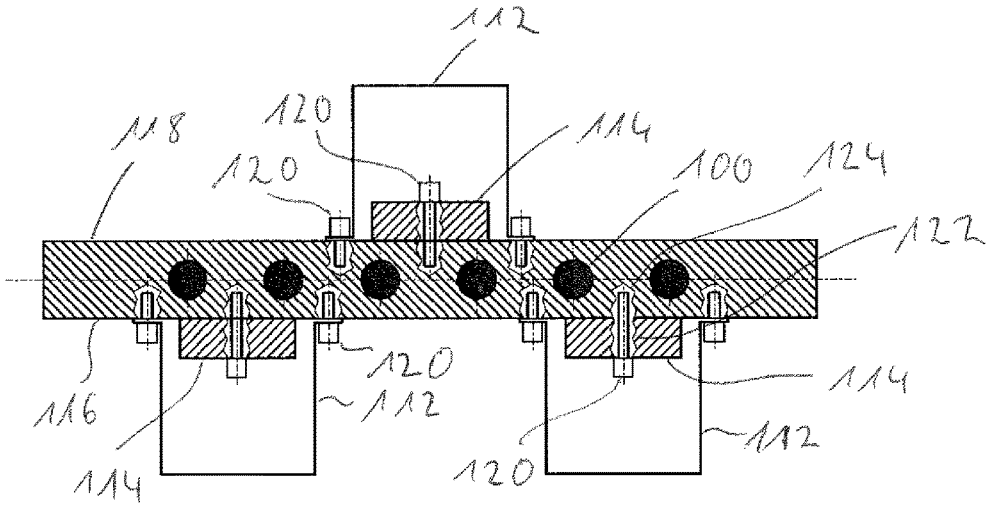
FIG. 7 shows a cross sectional view of the cooling plate of FIG. 6 along line VII-VII in FIG. 6.

In FIGS. 6 and 7 one example of attaching electrical components to a cooling plate 58 providing a cooling member 56 is shown. Cooling plate 58, which for example may be made of metal material, provides an undulating cooling liquid channel 100 having two connecting openings 102, 104 for connecting this cooling liquid channel 100 to a respective cooling liquid circuit. At two opposing side faces 106, 108 the channel 100 is closed by plate shaped closure members 110. Electrical components 112, 114 are attached to two opposing sides 116, 118 of the cooling plate 58. In the example shown in FIGS. 6 and 7 electrical components 112, 114 are fixed to the cooling plate 58 by using screws 120 passing through openings 122 provided in the electrical components 112, 114 and screwed into screw holes 124 of the cooling plate 58.

By using screws 120 for fixing the electrical components 112, 114 to the cooling plate 58 the electrical components 112, 114 are removably supported on the cooling plate 58 in direct heat transfer contact therewith. Therefore the electrical components 112, 114 can be attached to the cooling plate 58 in a simple and quick manner and can be detached from the cooling plate 58 in a simple and quick manner without destroying the electrical components 112, 114 and the cooling plate 58.

It is to be noted that other means can be used for removably attaching the electrical components 112, 114 to the cooling plate 58. For example rivets, snap fit connectors or press fit connectors may be used for fixing the electrical components 112, 114 to the cooling plate 58. Different means for fixing electrical components to the cooling plate 58 may be used in association to different electrical components. For example the electrical components 114, which might be or comprise converters producing a high amount of heat during operation, may be fixed to the cooling plate by means of the shown screws, while the electrical components 112, which might be or comprise printed circuit boards supporting a plurality of transistors, resistors, capacitors and the like, may be fixed to the cooling plate 58 by means of rivets or other fixation means. While it is advantageous to have all electrical components removably fixed to the supporting cooling plates, at least some of the electrical components may be fixed to at least one supporting cooling plate in a non-removable manner, for example by gluing them to a surface of a cooling plate. Further electrical components may be provided on both opposing sides of only some of the cooling plates or of all the cooling plates.

As shown in association with the controllers 18, 22, the cooling members 56 may be arranged such as to provide a first cooling member portion 62. In this first cooling member portion 62, the electrical components to be cooled are arranged in direct thermal contact with the respective cooling members 56. Further, these cooling members 56 provide second cooling member portions 64. In these second cooling member portions 64, no electrical components to be cooled are arranged, such that these second cooling member portions 64 are in thermal contact with the ambient air contained within a respective controller cabinet 30. Due to this thermal contact, the air contained within the controller cabinets 30 can be cooled. By means of a respective fan 66, an air circulation may be generated within the controller cabinets 30 such that, by the use of the circulation of cooled air, other electrical components, for example, the controller units 32, which are not in direct thermal contact with the cooling members 56 contained within the controller cabinets 30, can be cooled.

The operation of these fans 66 as well as the operation of the pumps 48 associated with the secondary cooling liquid circuits 42, 44, 46 may be controlled by the controller units 32 of the controllers 18, 20, 22. For controlling the fans 66 and/or the pumps 48, the controller units 32 may be arranged to receive information from a temperature sensor 68 measuring the temperature of the secondary cooling liquid flowing to the controllers 18, 20, 22, a temperature sensor 70 measuring the temperature of the secondary cooling liquid exiting the controllers 18, 20, 22, and a temperature sensor 72 measuring the ambient temperature, for example, outside the controller cabinets 30. There may be one single temperature sensor 72 for providing the temperature signal for all the controllers 18, 20, 22. In the embodiment shown in FIG. 1, there are a plurality of such temperature sensors 72 such that each controller unit 32 can carry out the control on the basis of a temperature signal indicating a temperature of the ambient air, for example, near the controller cabinet 30 of the associated controller 18, 20, 22.

According to the principles of the present invention, the flow of cooling liquid through the various cooling members 56 may be adjusted such that the temperature of the cooling liquid flowing to a respective cooling member 56 has a predetermined constant deviation from the ambient air temperature, i.e. the temperature detected by the temperature sensors 72. For example, the temperature of the cooling liquid flowing to a respective cooling member, which temperature is measured by the temperature sensors 68, may be adjusted such as to be in a temperature range of plus or minus 5° C. around the ambient air temperature. For adjusting the temperature of the cooling liquid flowing through the cooling members 56, the amount of secondary cooling liquid pumped by the pumps 48 may be adjusted and/or the multifunctional regulators 50 may be switched between the above-referenced two operational conditions for thereby adjusting the amount of heat transferred between the secondary cooling liquid circuits 42, 44, 46 and the primary cooling liquid circuit 36.

By controlling the temperature of the cooling liquid flowing to the controllers 18, 20, 22 to be cooled to be within the above-referenced range, water condensation within the controller cabinets, in particular in the area of the drives 34, which are in direct thermal contact with the cooling members 56, can be avoided.

As shown in FIG. 1, a secondary cooling liquid circuit, for example, secondary cooling liquid circuit 44, may be arranged such as to additionally provide a cooling function for at least one motor 26. For example, this can be a motor which is controlled by the one controller 20 that is cooled by the same secondary cooling liquid circuit 44. In the embodiment shown in FIG. 1, the cooling member 56 and the motor 26 which are cooled by the secondary cooling liquid of the same secondary cooling liquid circuit 44 may be arranged such that they are in parallel to each other. Optionally, these components may be arranged serially within the respective cooling liquid circuit.

As further shown in FIG. 1, the primary cooling liquid circuit 36 may comprise further connections 74 by means of which the primary cooling liquid circulated within the primary cooling liquid circuit 36 can be directed to additional components to be cooled. For example, the controllers of further tufting machines may be connected to the primary cooling liquid circuit 36 by using such additional connectors 74. In the embodiment shown in FIG. 1, the motor 28 is directly connected to the primary cooling liquid circuit 36 via the additional connectors 74. Therefore, motor 28 can be cooled by the primary cooling liquid flowing in the primary cooling liquid circuit 36.

Figure 2:
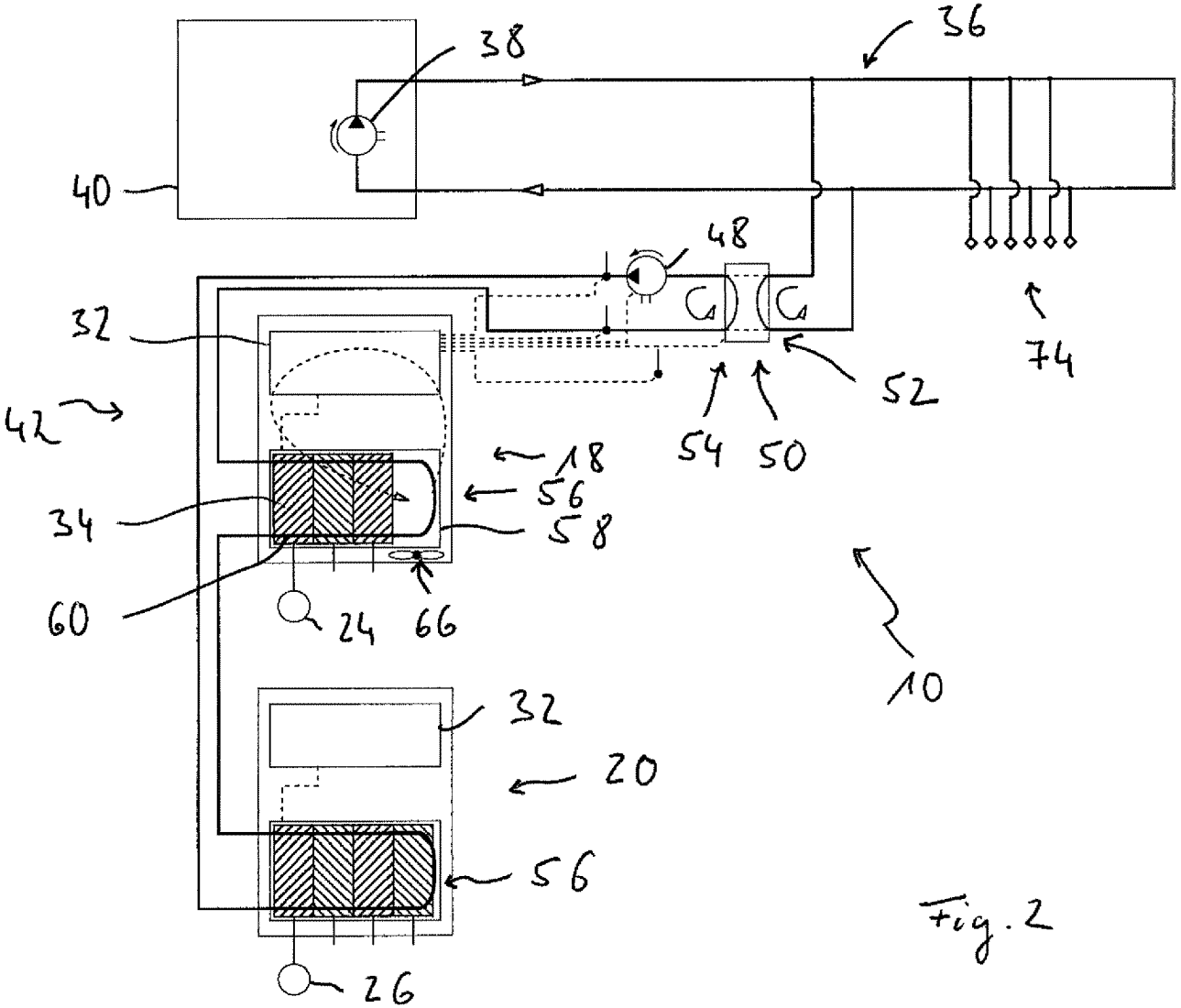
FIG. 2 shows an alternative embodiment of a portion of the cooling system of FIG. 1.

FIG. 2 shows a variation of the cooling liquid system 10. In this variation, the secondary cooling liquid circuit 42 is used for cooling electrical components of two controllers 18, 20. As can be seen, the cooling members 56 associated to these two controllers 18, 20 are arranged serially within the secondary cooling liquid circuit 42 such that the secondary cooling liquid pumped by pump 48 is delivered to the cooling member 56 of the controller 20 and, after having passed through this cooling member 56, is passed through the cooling member 56 of the controller 18.

It is to be noted that more than two controllers can be cooled by one and the same secondary cooling liquid circuit. Further, the cooling members associated to different controllers can be arranged in parallel to each other instead of the serial arrangement shown in FIG. 2. Further, a combination of cooling members arranged serially with respect to each other and cooling members arranged in parallel with respect to each other can be used.

Figure 3:
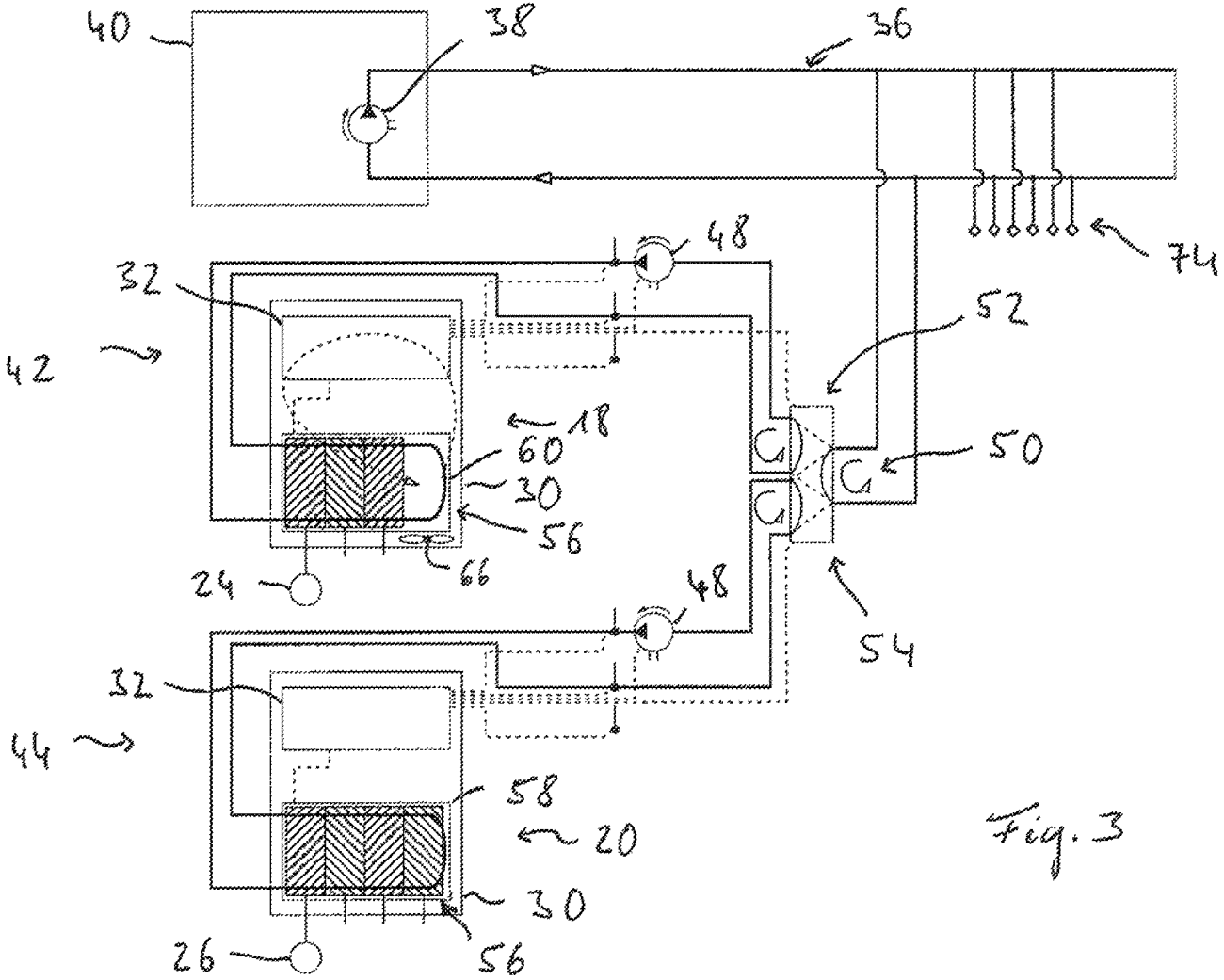
FIG. 3 shows a further alternative embodiment of a portion of the cooling system of FIG. 1.

In FIG. 3, a further variation of the cooling liquid system 10 is shown. Here, one multifunctional regulator 50 is used in association with two secondary cooling liquid circuits 42, 44. Each one of these secondary cooling liquid circuits 42, 44 is used for cooling one controller 18, 20. For example, at least one of these cooling liquid circuit 42, 44 might be used for cooling a plurality of controllers, as is shown in FIG. 2.

The multifunctional regulator 50 of the embodiment shown in FIG. 3, on the one hand, is arranged such as to provide the secondary heat exchanger 52 for transferring heat between the two secondary cooling liquid circuits 42, 44 and the primary cooling liquid circuit 36. The multifunctional regulator 50 is further arranged such as to provide the valve means 54 for generating a cooling liquid exchange communication between the secondary cooling liquid circuits 42, 44 and the primary cooling liquid circuit 36. The arrangement can be such that the two secondary cooling liquid circuits 42, 44 can be brought into cooling liquid exchange communication with the primary cooling liquid circuit 36 independently of each other, such that, for example, the secondary cooling liquid circuit 42 is in cooling liquid exchange communication with the primary cooling liquid circuit 36, while the secondary cooling liquid circuit 44 is in heat transfer communication, but not in cooling liquid exchange communication with the primary cooling liquid circuit 36. Further, the valve means 54 can be switched such that both the secondary cooling liquid circuits 42, 44 are in cooling liquid exchange communication with the primary cooling liquid circuit 36.

Again, it is to be noted that, by means of one and the same multifunctional regulator, more than two secondary cooling liquid circuits can be brought into and out of cooling liquid exchange communication with the primary cooling liquid circuit.

Figure 4:
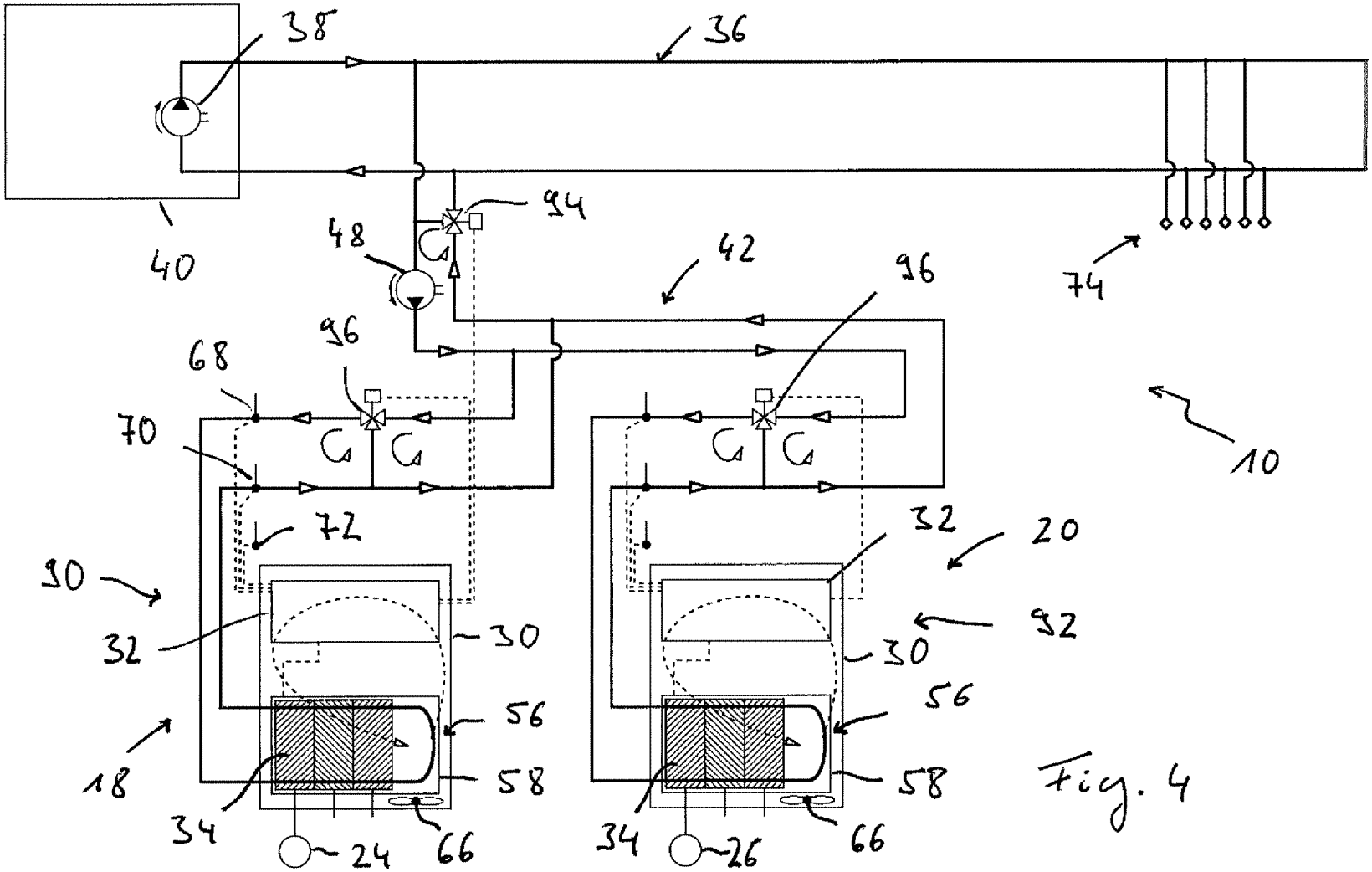
FIG. 4 shows a further alternative embodiment of a portion of the cooling system of FIG. 1.

FIG. 4 shows a further alternative aspect of a cooling liquid system 10. It is to be mentioned that the aspect shown in FIG. 4, of course, can be combined with one or a plurality of the constructional variations shown in and described with respect to the other figures.

In the variation shown in FIG. 4, there are two controllers 18, 20 contained in associated controller cabinets 30. The secondary cooling liquid circuit 42 used for cooling electrical components of these two controllers 18, 20 comprises two parallel branches 90, 92. The secondary cooling liquid circulated by the pump 48 of this secondary cooling liquid 42 flows through the cooling members 56 of the two controllers 18, 20 in a parallel manner such that the same cooling effect can be obtained in both the controllers 18, 20.

For selectively connecting and disconnecting the secondary cooling liquid circuit 42 to and from the primary cooling liquid circuit 36, a valve 94, e.g. a 3-port valve, may be arranged between the primary cooling liquid circuit 36 and the secondary cooling liquid circuit 42. For example, by means of the controller unit 32 of the controller 18 this valve 94 is controlled such as to adjust the amount of cooling liquid exchanged between the primary cooling liquid circuit 36 and the secondary cooling liquid circuit 42. If a high amount of heat has to be withdrawn from the controllers 18, 20, then the valve 94 may be controlled such as to provide a maximum cooling liquid exchange communication between the primary cooling liquid circuit 36 and the secondary cooling liquid circuit 42. If less heat has to be withdrawn, then the valve 94 can be controlled such as to reduce the amount of cooling liquid exchanged between the two cooling liquid circuits 36, 42 or to even completely disconnect the secondary cooling liquid circuit 42 from the primary cooling liquid circuit 36 such that the secondary cooling liquid circulated within the secondary cooling liquid circuit 42 by means of the pump 48 will only be circulated within this secondary cooling liquid circuit 42. The control can be such that, for example, depending on the temperature detected by the temperature sensors 68 and/or 70 and/or 72, the temperature of the secondary cooling liquid circuit flowing through the cooling members 56 is adjusted such as to be equal to or below a desired temperature within the controller cabinets 30 or in the area surrounding the controller cabinets 30.

For further adjusting the amount of cooling liquid passed through the respective cooling members 56 of the controllers 18, 20 in association with each one of the branches 90, 92 a further valve 96 may be provided, which, for example, may also be a 3-port valve and which may be controlled by the controller units 32 of the associated controllers 18, 20. By means of these valves 96, in each one of the branches 90, 92, the amount of cooling liquid passed through the cooling members 56 thereof can be adjusted individually. Therefore, even if a high amount of cooling is necessary in controller 18, while, due to a reduced load, substantially no cooling is necessary in the controller 20, the valve 96 associated with the branch 92 of the controller 20 can be controlled such as to reduce the flow of cooling liquid through the cooling member 56 of the controller 20 or to completely lock off this branch 92 such that a more efficient cooling can be obtained in the other branch 90. Again, the control of the valves 96 can be based on the temperature of the cooling liquid flowing in the respective branches 90, 92 and the desired temperature of the controllers 18, 20.

It is to be noted that more than two such branches can be associated with one and the same secondary cooling liquid circuit or that a plurality of secondary cooling liquid circuits, each one comprising at least two such parallel branches, may be provided. There even may be a combination of parallel and serial arrangement of controllers to be cooled within one and the same secondary cooling liquid circuit or within different secondary cooling liquid circuits.

It is further to be noted that in the embodiment shown in FIG. 4 as well as in the embodiments shown in the other figures one or a plurality of the valves may be arranged such as to be controllable by one or a plurality of controller units, as shown in the figures. Alternatively one or a plurality of the valves may be arranged such as to be manually controllable. For example, one or a plurality of the valves 96 for opening or closing the respective branches 90, 92 of the secondary cooling liquid circuit 42 may be manually controllable valves. Further the valve 94 for connecting or disconnecting the secondary cooling liquid circuit 42 to and from the primary cooling liquid circuit 36 may be a manually controllable valve.

In the arrangement shown in FIG. 4 as well as in all the other arrangements shown in the other figures in association to the secondary cooling liquid circuit 42 and/or in association to any other cooling liquid circuit a flow meter may be provided for providing information about the flow of cooling liquid within a respective cooling liquid circuit. This information may be used by any controller unit controlling one or a plurality of valves and/or pumps for indicating to one or a plurality of the controller units 32 of the controllers 30 that there is a sufficient flow of cooling liquid and that therefore the controllers can be operated for activating the motors or any other devices controlled by them.

Figure 5:
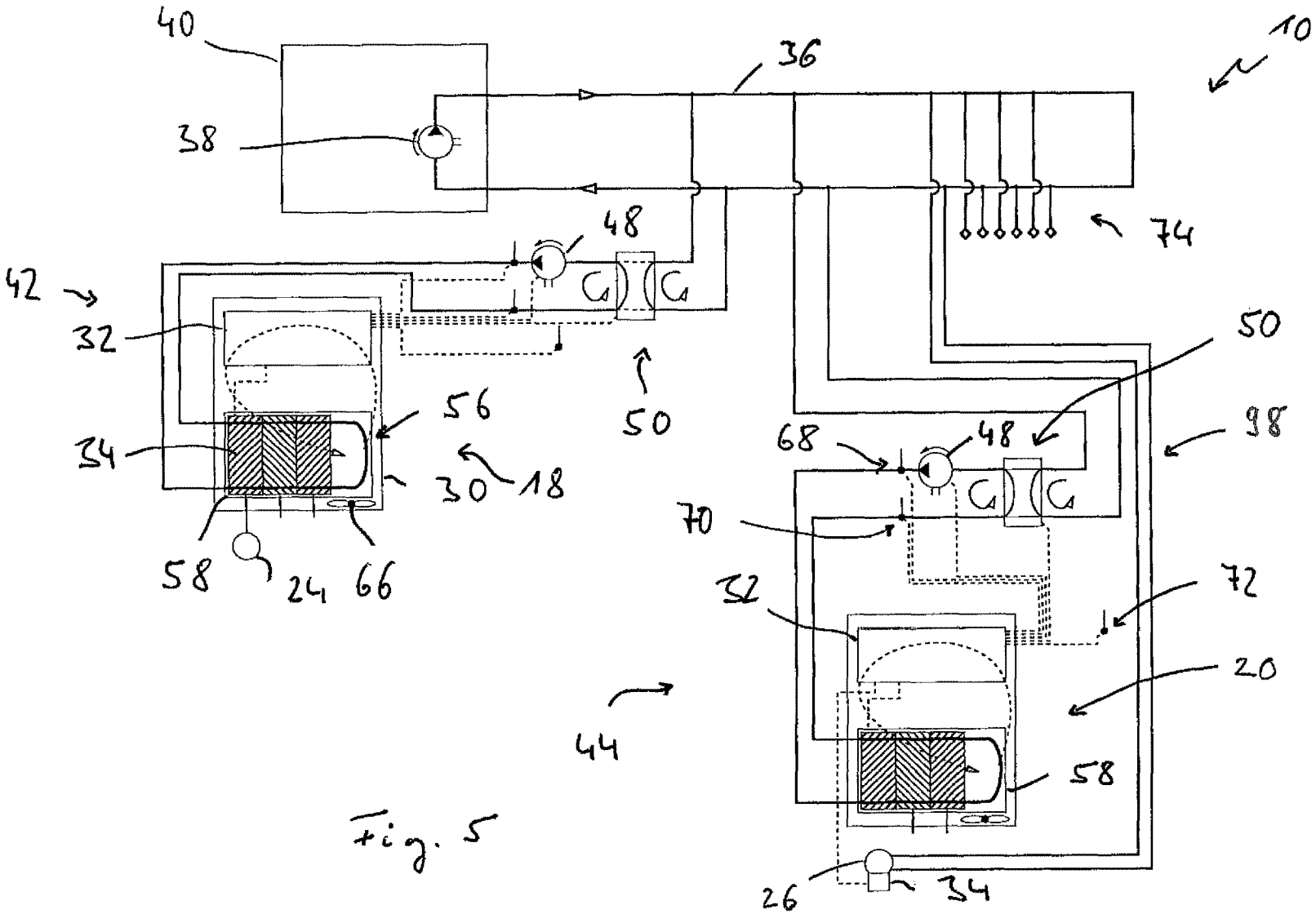
FIG. 5 shows a further alternative embodiment of a portion of the cooling system of FIG. 1.

A further variation of the cooling liquid system 10 of the present invention is shown in FIG. 5. In the variation of FIG. 5, there again are two secondary cooling liquid circuits 18, 20 which, by means of respective multifunctional regulators 50, can be connected, disconnected or brought into thermal contact with the primary cooling liquid circuit 36.

In association with the controller 18 cooled by the secondary cooling liquid circuit 42, there is shown one motor 24 which, for example, may be used for moving a needle bar. The drive 34 and the electrical components thereof, respectively, associated with this motor 24 are arranged in direct thermal contact with the cooling plate 58 arranged within the controller cabinet 30 of the controller 18. Due to this arrangement, the drive 34 is cooled by the secondary cooling liquid circulated in the secondary cooling liquid circuit 42.

In association with the controller 20 shown on the right-hand side of FIG. 5, there is provided a motor 26 having an integrated drive 34 for applying the energizing voltage to this motor 26. This means that the drive 34, as well as the motor 26, is not arranged within the controller cabinet 30 of this controller 20. However, there is a control connection between this drive 34 and the controller unit 32 of the controller 20 such that the controller unit 32 can control the operation of the motor 26 by outputting control signals to the drive 34 associated with this motor 26.

For cooling this motor 26 and/or the drive 34 associated with this motor 26, the primary cooling liquid circuit 36 comprises a branch 98 for passing the primary cooling liquid circulated in the primary cooling liquid circuit through a cooling liquid channel provided within the motor 26 and/or the drive 34. Such a branch 98 of the primary cooling liquid circuit 36 can also be seen in the embodiment of FIG. 1.

From the above explanation, it becomes clear that, according to an advantageous aspect of the present invention, a cooling liquid can be used to withdraw heat from electrical components and/or motors by using a direct thermal contact. According to a further advantageous aspect, the cooling liquid system of the present invention may be subdivided into one or a plurality of primary cooling liquid circuits and one or a plurality of secondary cooling liquid circuits. Due to the fact that each one of these cooling liquid circuits has its own pump associated therewith, the cooling liquids provided in these various cooling liquid circuits may be circulated independently of each other for adapting the cooling behavior to the amount of cooling that, based on the thermal condition within a respective controller or in the area surrounding the controllers, is necessary. Of course, this cooling effect can be used for cooling any kind of electrical or electronic components, for example, of a drive or a controller unit.

While, with reference to the drawings, specific embodiments of the cooling liquid system according to the present invention have been described, it is to be noted that the principles shown with respect to the different embodiments can be combined. Further, it is to be noted that, instead of individually controlling each one of the secondary cooling liquid circuits by means of a controller unit associated with a respective controller cooled by specific secondary cooling liquid circuit, a controller unit may control more than one secondary cooling liquid circuit or there may be a central cooling liquid circuit control unit receiving the temperature signals from the various temperature sensors and controlling the operation of the various multifunctional regulators and/or pumps for adjusting the heat transfer capacity of each one of the secondary cooling liquid circuits and the primary cooling liquid circuit, respectively.

The invention claimed is:

1. Tufting machine, comprising a plurality of operative assemblies, the operative assemblies comprising a needle bar drive mechanism for moving a needle bar towards and away from a backing material and a backing material feed mechanism for passing the backing material through a tufting zone, at least a part of the operative assemblies comprising motors, the motors being controlled by at least one controller having a plurality of electrical components, a cooling liquid system being provided for cooling at least one of the at least one controller, the cooling liquid system comprising at least one cooling member having a cooling liquid channel for the passage of a cooling liquid and being in heat transfer contact with at least a part of the electrical components of the at least one of the at least one controller, at least one of the at least one cooling member comprising at least one cooling plate supporting at least a part of the electrical components, and/or at least one of the at least one cooling member comprising a body of one of the electrical component.

2. The machine according to claim 1, wherein the cooling liquid system comprises a primary cooling liquid circuit and a primary cooling liquid flowing through the primary cooling liquid circuit, further comprising a primary heat exchanger for cooling the primary cooling liquid.

3. The machine according to claim 2, wherein the cooling liquid system comprises at least one secondary cooling liquid circuit and a secondary cooling liquid flowing through the secondary cooling liquid circuit and passing through the cooling liquid channel of at least one cooling member.

4. The machine according to claim 3, wherein the cooling liquid system comprises at least one secondary heat exchanger for transferring heat from the secondary cooling liquid of at least one secondary cooling circuit to the primary cooling liquid of the primary cooling circuit, and/or wherein the cooling liquid system comprises at least one valve means for bringing at least one secondary cooling liquid circuit into and out of cooling liquid exchange communication with the primary cooling liquid circuit.

5. The machine according to claim 4, wherein the cooling liquid system comprises at least one multifunctional regulator comprising a valve means and a secondary heat exchanger for cooling a secondary cooling liquid by means of the primary cooling liquid in a condition in which the primary cooling liquid circuit is brought out of cooling liquid exchange communication with at least one secondary cooling liquid circuit by the valve means.

6. The machine according to claim 4, wherein at least one secondary heat exchanger is arranged for transferring heat from the secondary cooling liquids of at least two secondary cooling liquid circuits to the primary cooling liquid of the primary cooling liquid circuit, and/or wherein at least one valve means is arranged for bringing at least one secondary cooling liquid circuit of a plurality of secondary cooling liquid circuits into and out of cooling liquid exchange communication with the primary cooling liquid circuit.

7. The machine according to claim 1, wherein the at least one cooling member comprises a first cooling member portion in heat transfer contact with electrical components of the at least one of the at least one controller and a second cooling member portion not in heat transfer contact with at least a part of the electrical components of the at least one of the at least one controller for providing a heat exchanger area for cooling ambient air.

8. The machine according to claim 1, wherein a fan is associated with at least one of the at least one controller for generating an ambient air flow through the at least one controller.

9. The machine according to claim 1, wherein means for adjusting the amount of cooling liquid passing through the cooling liquid channel of at least one of the at least one cooling member are provided, and/or wherein means for adjusting the temperature of the cooling liquid passing through the cooling liquid channel of at least one of the at least one cooling member are provided.

10. The machine according to claim 9, wherein the means for adjusting the amount of cooling liquid passing through the cooling channel of the at least one of the at least one cooling member comprise a cooling liquid pump and/or a valve.

11. The machine according to claim 4, wherein means for adjusting the amount of cooling liquid passing through the cooling liquid channel of at least one of the at least one cooling member are provided, and/or wherein means for adjusting the temperature of the cooling liquid passing through the cooling liquid channel of the at least one of the at least one cooling member are provided, and wherein the means for adjusting the temperature of the cooling liquid passing through the cooling liquid channel of the at least one of the at least one cooling member comprise means for adjusting the amount of primary cooling liquid flowing through at least one first secondary heat exchanger.

12. The machine according to claim 1, wherein at least one of the at least one controller comprises a controller cabinet, at least part of the electrical components of the at least one of the at least one controller and the at least one of the at least one cooling member being arranged inside the controller cabinet.

13. The machine according to claim 1, wherein one controller is provided for controlling the operation of all motors of the tufting machine.

14. The machine according to claim 1, wherein a plurality of controllers are provided for controlling the operation of all motors of the tufting machine.

15. The machine according to claim 1, wherein, in at least one cooling liquid circuit of the cooling liquid system, at least two cooling members are arranged serially and/or at least two cooling members are arranged in parallel with each other for the passage of cooling liquid flowing in the cooling liquid circuit.

16. The machine according to claim 15, wherein at least two of the cool members are associated with different controllers.

17. The machine according to claim 1, wherein at least one motor controlled by at least one of the at least one controller is cooled by a cooling liquid flowing in a cooling liquid circuit of the cooling liquid system.

18. The machine according to claim 17, wherein, in at least one cooling liquid circuit, at least one the at least one cooling member and at least one motor are arranged serially or in parallel to each other for the passage of cooling liquid flowing in the cooling liquid circuit.

19. The machine according to claim 1, wherein at least one of the at least one cooling member is in heat transfer contact with electrical components at two opposing sides hereof, and/or wherein at least one side of the at least one of the at least one cooling member and at least one electrical component is removably supported.

* * * * *